US009657707B2

(12) United States Patent
Demmons

(10) Patent No.: US 9,657,707 B2
(45) Date of Patent: May 23, 2017

(54) AUTONOMOUS GLOW DRIVER FOR RADIO CONTROLLED ENGINES

(71) Applicant: Sheldon J. Demmons, Leicester, NC (US)

(72) Inventor: Sheldon J. Demmons, Leicester, NC (US)

( * ) Notice: Subject to any disclaimer, the term of this patent is extended or adjusted under 35 U.S.C. 154(b) by 192 days.

(21) Appl. No.: 14/685,683

(22) Filed: Apr. 14, 2015

(65) Prior Publication Data

US 2016/0305394 A1 Oct. 20, 2016

(51) Int. Cl.
*F02P 19/02* (2006.01)
*F02B 75/34* (2006.01)

(52) U.S. Cl.
CPC ..... *F02P 19/023* (2013.01); *F02B 75/34* (2013.01); *F02P 19/025* (2013.01); *F02P 19/026* (2013.01)

(58) Field of Classification Search
CPC ..... F02B 75/34; F23Q 7/001; H01R 24/20; H01R 13/621; H01R 2101/00; H01T 13/04
See application file for complete search history.

(56) References Cited

U.S. PATENT DOCUMENTS 3,435,404 A 3/1969 Kato
4,130,853 A 12/1978 Baker
4,283,619 A 8/1981 Abe
4,516,543 A * 5/1985 Abe ..... F02P 19/025 123/145 A
4,939,347 A * 7/1990 Masaka ..... F02P 19/022 123/179.6
5,367,995 A 11/1994 Kondo
6,009,369 A * 12/1999 Boisvert ..... F02P 19/026 123/145 A
6,276,325 B1 8/2001 Arlton
6,575,039 B2 6/2003 Murai et al.
6,691,660 B2 2/2004 Silva, II et al.
6,734,399 B2 5/2004 Asano et al.
(Continued)

FOREIGN PATENT DOCUMENTS

DE 102009046763 A1 5/2001
EP 1710431 A1 10/2006

OTHER PUBLICATIONS

Oregon Scale Aviation, Inc., AutoGlow Installation and Users Manual, Doc #108101, http://www.oregonscaleaviation.com, Accessed Jan. 20, 2015.

*Primary Examiner* — Joseph Dallo
(74) *Attorney, Agent, or Firm* — Luedeka Neely Group, P.C.

(57) ABSTRACT

An autonomous glow driver system for radio controlled (RC) engines. Aspects of the system include a connector that securely attaches to the glow plug to maintain good electrical contact with the glow plug and reduce signal noise and using a current and differential amplifiers to determine the temperature of the glow element and the RPMs of the glow engine from a voltage signal (obtained via the connector) that varies with the temperature as induced changes in the resistance of the glow element occur. Using the data of temperature, non-running RPM, and running RPM to control operation of the glow driver leads to a very reliable approach to automatically activating the glow driver to maintain the combustion chamber temperature of the glow engine at a selected level because RPM is indicative of a rotating engine whereas temperature is not.

13 Claims, 12 Drawing Sheets

(56) References Cited

U.S. PATENT DOCUMENTS

| | | | | |
|---|---|---|---|---|
| 6,878,903 | B2 * | 4/2005 | Duba | F23Q 7/001 219/264 |
| 7,487,753 | B2 * | 2/2009 | Gotou | F02P 19/021 123/145 A |
| 7,631,625 | B2 | 12/2009 | De Pottey | |
| 8,280,609 | B2 * | 10/2012 | Ehlert | F02P 19/021 123/145 A |
| 8,577,583 | B2 * | 11/2013 | Kernwein | F02P 19/022 123/145 A |
| 9,394,874 | B2 * | 7/2016 | Nakamura | F02P 19/023 |
| 2006/0289425 | A1 * | 12/2006 | Serra | F02P 19/025 219/270 |
| 2007/0240663 | A1 * | 10/2007 | Hiramatsu | F02D 41/221 123/179.6 |
| 2009/0008378 | A1 * | 1/2009 | Kernwein | F02P 19/021 219/260 |
| 2009/0012695 | A1 * | 1/2009 | Kernwein | F02P 19/026 701/102 |

* cited by examiner

AUTONOMOUS GLOW DRIVER FOR RADIO CONTROLLED ENGINES

CROSS-REFERENCE TO RELATED APPLICATIONS

Not Applicable.

BACKGROUND

This invention relates to the field of glow drivers and, in particular, to a connector and controller used for transmitting and controlling the delivery of electrical power from an energy supply to a glow plug when starting and running a model glow engine used in a radio controlled (RC) vehicle.

Small engines, such as those used in remote-controlled model airplanes, cars, boats, etc. are described as a glow engine because they are equipped with a glow plug. The glow plug, which includes a resistive circuit or glow element, is typically threaded into the engine so that the glow element is located in the combustion chamber of the engine. In operation, the glow element is used to facilitate the catalytic reaction between an air/fuel mixture and the glow element, which takes place within the combustion chamber. This reaction produces useful mechanical power used for powering the vehicle. In starting and operating a model vehicle, it is important to establish a proper temperature within the combustion chamber in order to ensure proper fuel combustion and for preventing "flame outs" of the engine, where the engine shuts off and must be restarted.

When the glow engine is operating at normal operating revolutions per minute (RPMs), the temperature of the engine is sufficient that the glow element remains hot and, thus, ensures that the combustion chamber remains hot and that ignition occurs when the gases in the combustion chamber are compressed. However, it can be a particularly difficult task to initially start glow engines when the glow element and the combustion chamber is cold. To start a glow engine in this condition, the glow element is initially heated by applying electricity, typically in the form of a battery powered glow driver, which is temporarily mounted to the stem of the glow plug and then removed once the engine has been successfully started.

While the glow driver heats the glow plug, which heats the combustion chamber, the user attempts to start the engine. In the case of a model airplane, for example, a user might use a field starter to turn the propeller. As mentioned above, once the engine starts operating, the heat from its operation is typically enough to ensure that the glow element and the combustion chamber remain hot and the electric power or glow driver is quickly removed in order to extend the life of the batteries and the resistive glow element in the glow driver. As such, ideally, electricity is provided to the glow plug very briefly and only as long as necessary for the engine to be successfully started.

One issue, however, relates to when starting has actually occurred. In particular, there is a difference between (1) an engine that is turning due to an outside force (such as a field starter) and is not running under its own power (i.e., a non-running RPM or NR-RPM) and (2) an engine that is turning and running under its own power (i.e., a running RPM or R-RPM). The engine is successfully started and the glow driver should be removed only after there is a running RPM of the engine. If the glow driver is removed too early, the temperature of the combustion chamber may not be sufficiently hot and the engine may not start successfully.

In addition to the initial starting as discussed above, maintaining a proper temperature in the combustion chamber is also important during the operation of the vehicle in order to ensure a proper glow element temperature to ensure continued ignition of the fuel. This is particularly important for model planes or model boats, where losing power could cause the vehicle to crash or become stranded in a body of water. If the combustion chamber becomes cold, the glow plug will also become cold when it is not being heated by some external energy source, such as a battery as discussed above. This reduction in combustion chamber and glow plug temperature might occur for a number of reasons. For example, if the engine is idling for an extended period of time, such as during the landing portion of the flight, if the ambient temperature drops, or if an excessive amount of fuel enters the system and causes rapid cooling or flooding to occur. Once the glow plug becomes cold, there is a chance the air/fuel mixture will not combust and the engine will flame out. In that situation, it is unlikely that engine will maintain ignition if the on-board glow driver is not activated. However, as mentioned above, glow drivers, which provide electrical power to heat the glow plug, are often removed after the engine has been initially started. As such, one problem associated with the removal of the glow driver is that these engines lack the ability to correct a drop in combustion chamber temperature that takes place during the operation of the engine.

Prior devices have included a variety of connection means for connecting a power source to a glow plug. For example, certain prior connectors were comprised of a pair of alligator-type clips, each connected by a wire to one side of a battery. At the opposite end of the wires, one clip was attached to the glow plug stem and the other clip was attached to the body of the glow plug or the engine. One disadvantage with this design is that several steps were required to connect the various wires between power source and the glow plug.

Other devices have endeavored to simplify the connection process by providing a connector that can be mounted to glow plug at one connection point. For example, one such as the device is disclosed in U.S. Pat. No. 3,435,404. The device in the '404 patent includes a snap on connector that includes a contact point that is spring mounted, which contacts the stem of the glow plug. One major disadvantage of the design of the '404 patent is that the spring and contact point fails to provide a rigid, stable connection with the glow plug, which allows the connector to move, vibrate, rotate, etc., which is exacerbated during the use and operation of the engine. This becomes apparent when taking voltage readings, because taking these readings with a loose connection tends to create electrical noise leading to erroneous data.

As discussed below, taking voltage readings from a glow plug connector is important because these readings provide valuable information about the operation and state of the glow plug. Obtaining accurate data, with little or no noise, is also important because providing better data to the controller will enable the system to operate more effectively.

What is needed, therefore, is a device that enables a glow engine to be heated during the start-up phase and the use or running phase and that is capable of distinguishing between a running and non-running state.

BRIEF SUMMARY

The following summary discusses various aspects of the invention described more fully in the detailed description and claimed herein. It is not intended and should not be used to limit the claimed invention to only such aspects or to require the invention to include all such aspects.

The system includes a combustion chamber heater having a heating element located in a portion of the glow engine having a combustion chamber. A control module controls the temperature of a combustion chamber based on the temperature of the heating element, determined by the amount of voltage supplied to the heating element, and the revolutions per minute of the glow engine, determined from a time interval between pulses in the amount of voltage supplied to the heating element. A connector is mounted to the glow plug and connects the heating element to the control module.

In certain embodiments, the connector mounts to a glow plug having a stem, and includes an electrically conductive housing. The housing includes an upper and a lower housing portion. The lower housing portion includes a bottom lip having a hexagonal opening configured to receive the glow plug in a first orientation. The lower housing also includes a hexagonal internal lip that is located within the lower housing portion immediately adjacent the bottom lip that is offset from the hexagonal opening of the bottom lip. The internal lip is configured to limit the rotation of the glow plug when a portion of the glow plug is seated on the bottom lip in a second orientation.

The housing also includes an upper housing portion connected to the lower housing portion. The upper housing portion has a top opening, a side opening, and a shoulder connecting the lower and upper housing portions. An electrically non-conductive ring-shaped first insert is positioned on the shoulder of the housing. The first insert has a central opening, a plurality of electrical lead pathways disposed around the central opening, and a lead insertion surface. The lead insertion surface is configured for placement adjacent the side opening of the upper housing portion. This allows electrical leads to be fed through the side opening, through the lead pathways, and connected to various portions of the connector.

The connector also includes an electrically conductive second insert. The second insert has a tube section with internal threads on an inner surface of the tube section. The tube section is inserted into the central opening of the housing and fixed therein. Next, an electrically conductive threaded member having a threaded shaft engages the internal threads of the second insert. The threaded shaft has a bottom having a bore. The bore is designed to receive a stem end of a glow plug. In use, rotating the threaded member imparts a downwards pressure through the glow plug onto the bottom lip of the housing to hold the glow plug steady and to reduce movement.

As detailed below, advantages of the present design are that the present design allows for a superior, one-point connection to the glow plug and also minimizes noise that is present in the voltage readings by providing a rigid connection with the glow plug, which enables the device to accurately determine the glow plug element temperature, engine RPM, and engine state by distinguishing between a running RPM and non-running RPM state. The device, therefore, is effective at maintaining a suitable combustion chamber temperature during the start-up and running phase of the engine.

BRIEF DESCRIPTION OF THE DRAWINGS

Further features, aspects, and advantages of the present disclosure will become better understood by reference to the following figures, wherein elements are not to scale so as to more clearly show the details and wherein like reference numbers indicate like elements throughout the several views.

DETAILED DESCRIPTION

An autonomous glow driver system for radio controlled (RC) engines is described herein and illustrated in the accompanying figures. Aspects of the system include a connector that securely attaches to the glow plug to maintain good electrical contact with the glow plug and reduce signal noise and using a current and differential amplifiers to determine the temperature of the glow element and the RPMs of the glow engine from a voltage signal obtained via the connector that varies with the temperature induced changes in the resistance of the glow element. Using the data of temperature, non-running RPM, and running RPM to control operation of the glow driver leads to a very reliable approach to automatically activating the glow driver to maintain the combustion chamber temperature of the glow engine at a selected level because RPM is indicative of a rotating engine whereas temperature is not.

Figure 1:
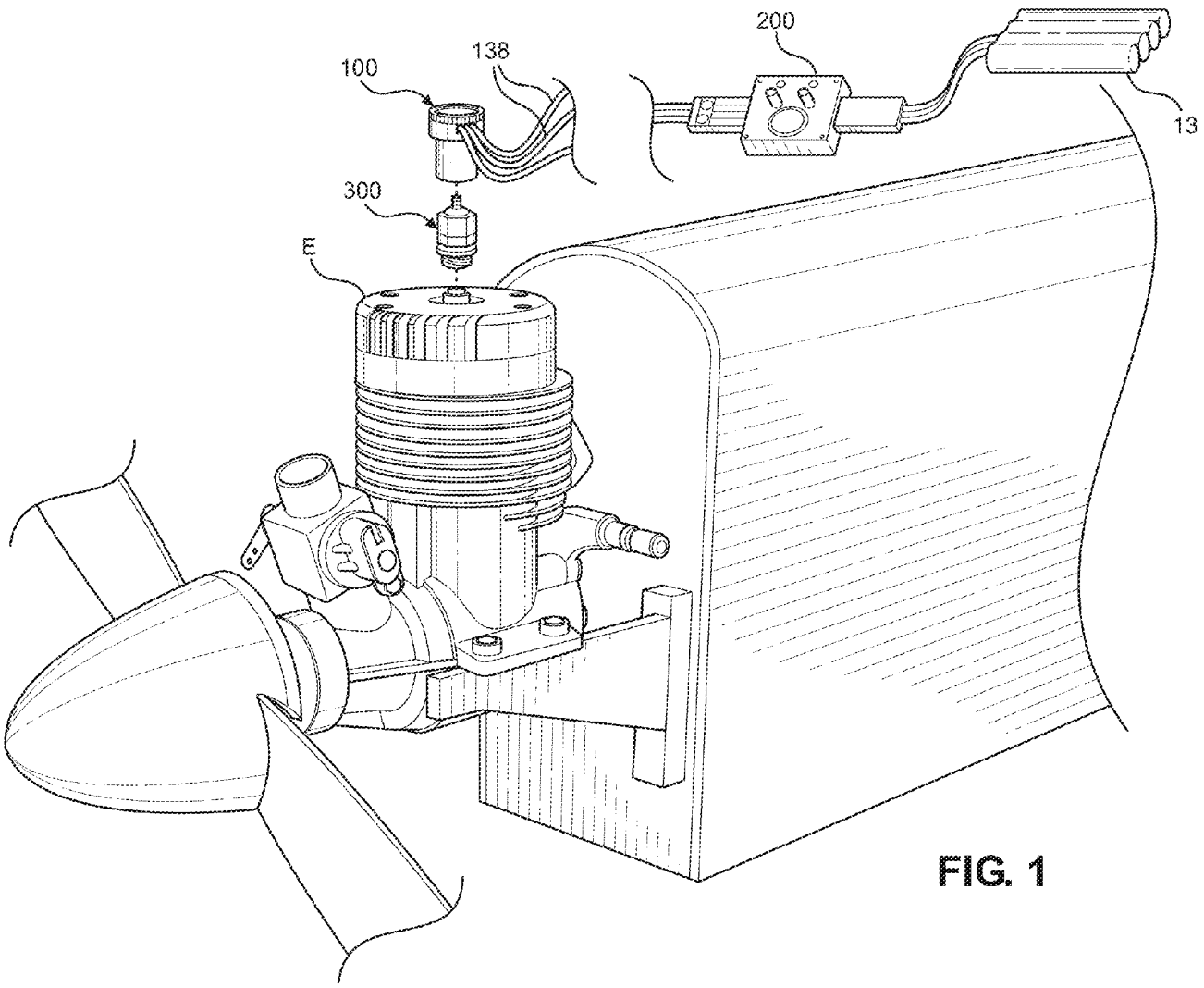
FIG. 1 is a perspective view of a model engine for an airplane equipped with a glow plug and glow plug connector according to an embodiment of the present invention.

FIG. 1 illustrates on embodiment of a connector 100 for use in connection with a model engine E that is equipped with a glow plug. Typically, the glow plug is threaded into a cylinder head of the glow engine and assists in heating the combustion chamber. The connector 100 is mounted onto a top portion of the glow plug that extends away from the glow engine. The connector 100 is connected to a control module 200, which is connected to a power source such as a battery B, and controls the operation of the glow plug.

The glow plug is inserted into the interior of the housing member and is held there by a restricting member that selectively prevents the glow plug from being removed from the interior of the housing. After the glow plug is held in place within the housing member, it is fixed in placed by a fixing member. The fixing member provides sufficient pressure to secure the glow plug in contact with the restricting member and to reduce movement of the glow plug. Once the glow plug contacts the restricting member, an electrical circuit is formed through the connector. A voltage source, such as a battery, is connected to the electrical circuit to provide electricity to power a glow element in the glow plug. The pressure provided by the fixing member provides a very tight connection between the glow plug and the connector, which will reduce movement and vibration. As mentioned above, reducing movement and vibration allows for better data to be acquired when taking voltage readings from the glow plug.

Turning the engine over causes the glow plug to activate until the engine is running on its own. In the case of certain remote control planes, the engine may be initially turned over by applying a field starter to the nose cone of the propeller. The field starter causes the propeller to rotate at a higher rate of speed than could be accomplished by hand.

This device may be used in an on-board or off-board configuration. The term on-board is often used when all of the components, including the connector, glow plug, and power source (excluding field starter) are carried with the vehicle during operation. The term off-board is often used when one or more of the components are not carried with the vehicle during operation. For example, in an off-board setup for an airplane, the connector may be mounted to the engine and have electrical leads that protrude from the fuselage. The control module and power source may be mounted separate from the model engine and connector, such as in a separate control station, and connected to the engine only during the initial startup phase and then disconnected. On the other hand, in an on-board configuration, the control module and power source may be mounted to the engine during the initial startup and during the operation of the engine.

The possibility of an autonomous glow driver is possible based on temperature alone; however the reliability of such would be questionable. Using the data of temperature, non-running RPM and running RPM, leads to a very reliable approach to autonomy. RPM is indicative of a rotating engine whereas temperature is not. The combination of temperature and RPM enables the controller glow driver to determine if the engine is turning on its own or due to an outside influence, such as a field starter.

Figure 2:
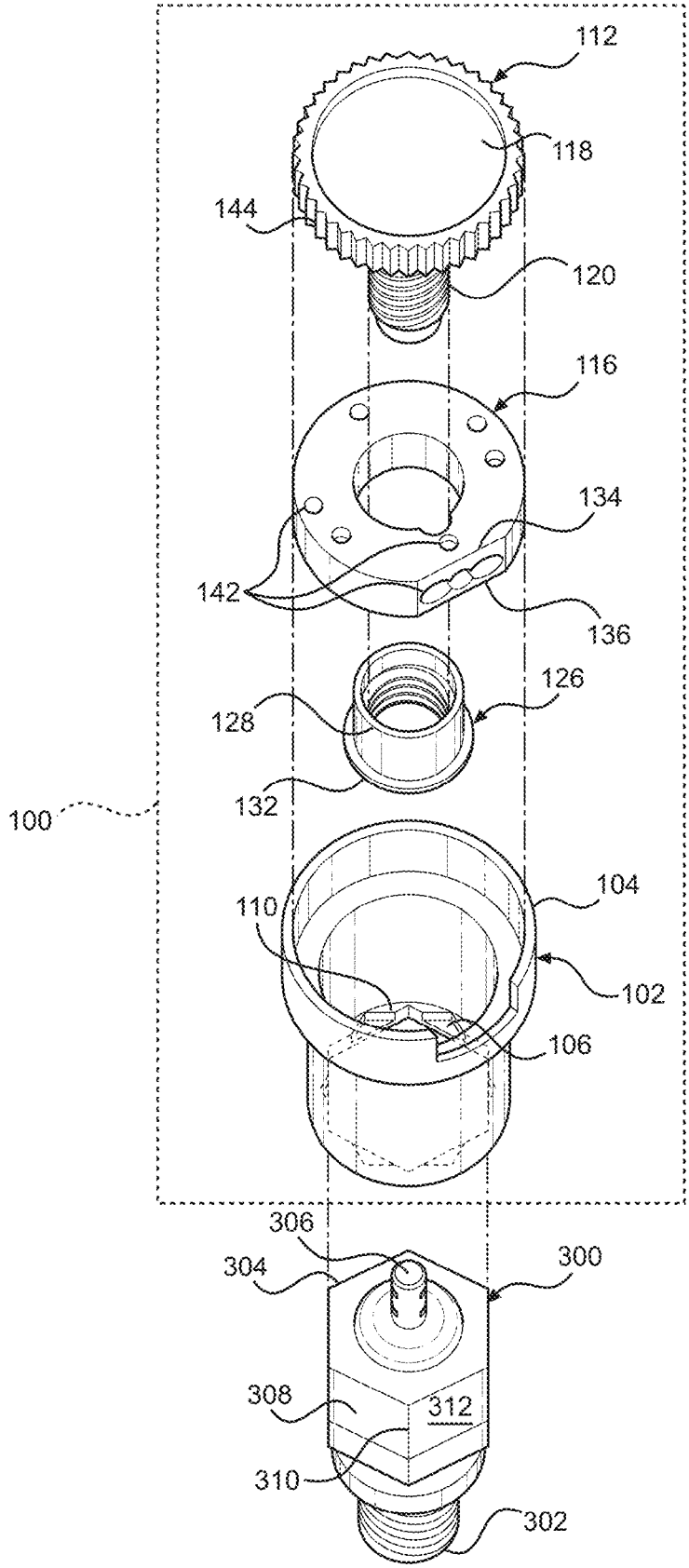
FIG. 2 is an exploded view of a glow plug and glow plug connector according to an embodiment of the present invention.
Figure 3:
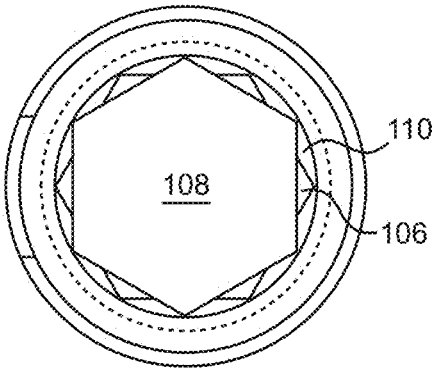
FIG. 3 is a top-down plan view of a housing for a glow plug connector according to an embodiment of the present invention.
Figure 4:
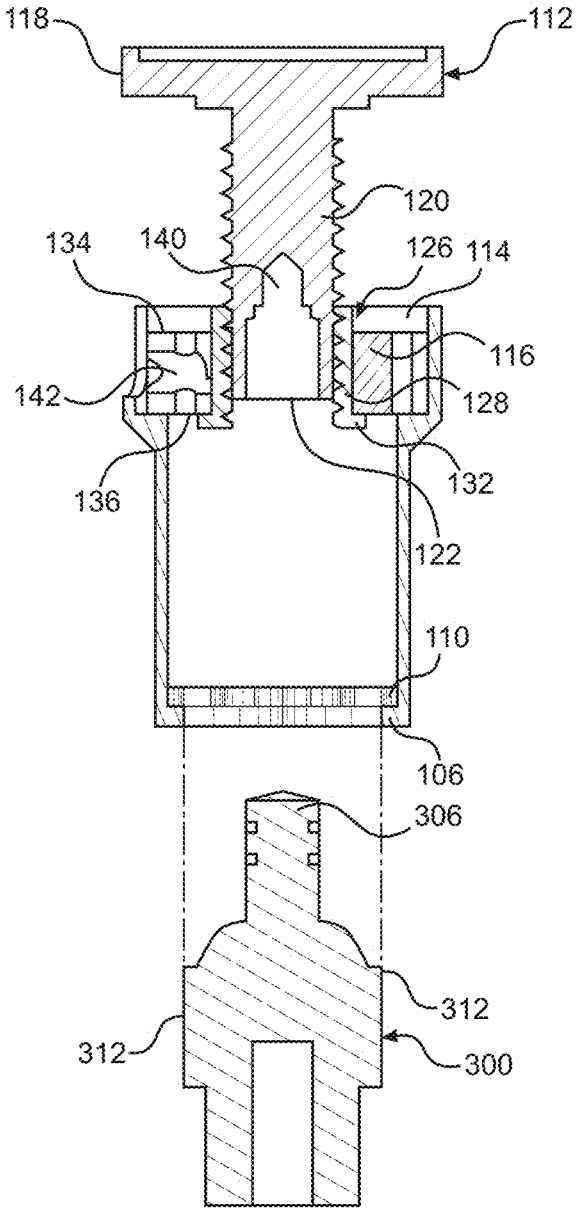
FIG. 4 is a front elevation view of a glow plug and glow plug connector according to an embodiment of the present invention where the glow plug has been partially inserted into the connector.

With reference to FIGS. 2-4, the glow plug 300 includes a threaded end 302 that is threaded into the glow engine E (FIG. 1), a stem end 304 having a stem 306, and a hexagonal body portion 308 located between the threaded end and the stem end having six corners 310 and six faces 312. It should be noted, however, that this design could be modified to cover shapes other than hexagonal glow plugs.

The connector 100 generally includes a housing member 102 having an interior space that is designed to receive at least a portion of the glow plug 300. The housing 102 can be divided into a lower portion, where the body portion and stem end of the glow plug are located, and a top portion where the fixing member is located. In certain embodiments, the interior space is defined by an outer wall 104. The outer wall 104 includes a bottom having a first lower shoulder 106 that includes an opening 108 having a first profile, such as a hexagonal profile, that is designed to receive the stem end 304 and body portion 308 of the glow plug 300. The housing 102 also includes a top opening 114 that is located opposite from the bottom opening 108, which is configured to receive a fixing member and insert, as discussed in detail below.

The first lower shoulder 106 may be formed as one component that extends around the inside of the outer wall 104. Alternatively, the first lower shoulder 106 may include one or more discreet shoulder portions that extend inwards from the outer wall 104. The first shoulder 106 serves as a restricting member that can be used to selectively prevent the glow plug 300 from being removed from the interior of the housing 102 after it has been inserted into the interior space. In particular, after the glow plug 300 is inserted through the bottom opening 108, it may be turned slightly so that the bottom surface of the corners 310 of the glow plug contact the top of the first shoulder 106.

FIG. 3 illustrates one embodiment in which a second lower shoulder 110 is placed directly above the first lower shoulder 106. The second lower shoulder 110 may be separated from the first lower shoulder 106, or they may be formed as a single component. The second lower shoulder 110 limits the rotation of the glow plug within the housing 102 once it has been placed onto the first lower shoulder 106. In this particular embodiment, the second lower shoulder 110 is comprised on a plurality of extensions, such as triangular extensions, that are placed on top of the first lower shoulder 106 and that are arranged so that an empty space, a second profile, such as a hexagon, is formed within the extensions. That second profile is offset from the first profile of the bottom opening 108. In this particular, embodiment, the first lower shoulder 106 (first profile) and the second lower shoulder 110 (second profile) are offset by about 30°. However, the first lower shoulder 106 and the second lower shoulder 110 may be offset by more than 0° to less than 60°. If the glow plug is provided with a body portion that is a shape other than a hexagon, such as a square or triangle, the connector 100 and the components associated therewith could be modified to accommodate that shape. The degree of rotation may also vary with different shapes. For example, the degree of offset in other embodiments may vary from more than 0° to less than 120°.

In use, as mentioned above, the glow plug 300 is first inserted into the interior space of the connector 100 through the opening formed in the first lower shoulder 106. The glow plug 300 is then rotated about 30° and the bottom surface of the corners 310 of the glow plug are seated on the top of the first lower shoulder 106 within the hexagonal cutout portion formed by the second lower shoulder 110 extensions.

The connector 100 may also include a fixing member to fix the glow plug 300 within the housing 102. In this particular embodiment, the fixing member is a threaded thumb turn 112. However, other similar devices may be used in place of a thumb turn in order to fix the glow plug 300 within the housing 102. The thumb turn 112 places pressure onto the glow plug 300 in order to limit its movement within the housing 102, especially vertical movement. The thumb turn 112 has a head 118 and a threaded shaft 120 having a bottom opening 122. The threaded shaft 120 is designed to mesh with threads that are located in a central opening of a first insert 116. The head 118 of the thumb turn 112 may include a non-slip surface 144, such as ridges, along its perimeter. The non-slip surface 144 assists a user in rotating the head 118 of the thumb turn 112 to reduce slipping. This enables a user to adequately tighten the thumb turn 112 so that sufficient pressure is placed onto the glow plug 300 to limit movement and vibration.

Figure 6:
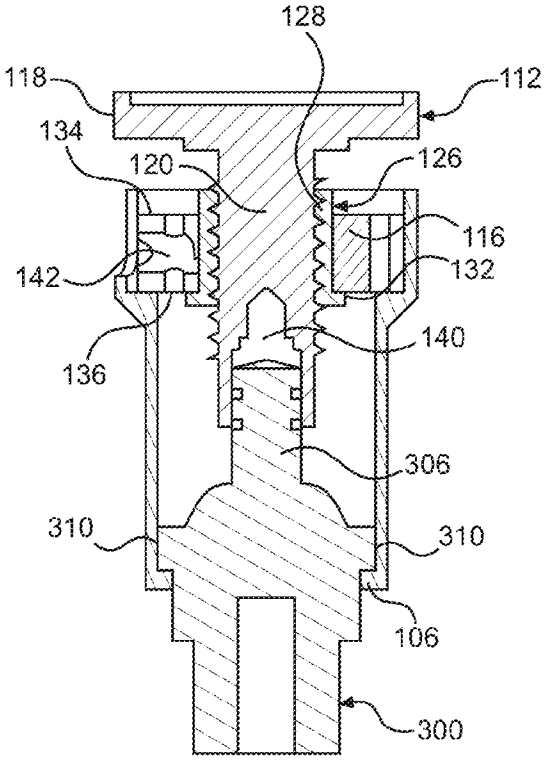
FIG. 6 shows the glow plug of FIG. 4 after a threaded thumb turn has been secured over a stem of the glow plug.
Figure 5:
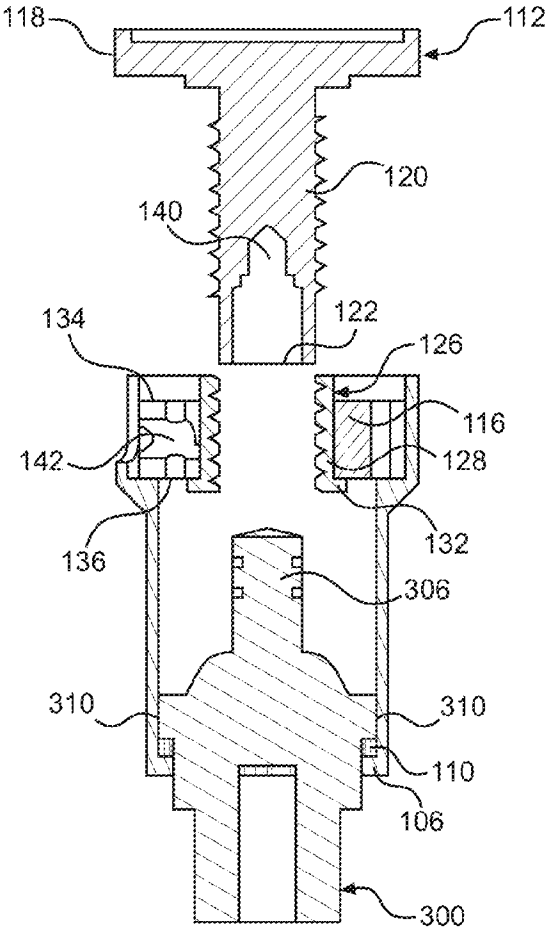
FIG. 5 shows the glow plug of FIG. 4 after being fully inserted into the glow plug connector.

With reference to FIGS. 4-6, the threaded shaft 120 extends into the interior of the housing 102 and the bottom opening 122 is configured to mount to the glow plug stem stem 306. The bottom opening 122 of the thumb turn 112 includes a bore 140 that extends at least partially along the inside of the threaded shaft 120. The bottom opening 122 is sized and configured so that the stem 306 of the glow plug 300 may be inserted into the bottom of the threaded shaft 120. Since the size and diameter of glow plugs varies, the bottom opening 122 and bore 140 may be designed to accommodate various sizes of glow plug stems. In certain embodiments, the bore 140 includes multiple concentric bores having a variety of lengths and diameters to accommodate glow plug stems of various sizes. For example, in this particular embodiment, the bore 140 includes a first bore having a diameter that extends a first distance into the threaded shaft, a second bore having a smaller diameter that extends a second distance into the threaded shaft, and a third bore having an even smaller diameter that extends a third distance into the threaded shaft 120.

The lower shoulders 106, 110 limits the rotation of the glow plug within the housing 102, and the thumb turn 112 limits the vertical movement of the glow plug within the housing. This provides for a very stable, rigid connection that reduces movement of the glow plug, maintains good contact between the glow plug and the connector, and reduces noise in voltage measurement data.

The connector 100 includes a first insert 116, which correctly locates the thumb turn 112 with respect to the glow plug stem 306. The first insert 116 is generally ring-shaped, having a top surface 134, a bottom surface 136, and an opening through which the threaded shaft 120 of the thumb turn 112 may be inserted. The central opening 124 may include threads that mesh with the threads of the thumb turn 112. Turning the fixing member 112 causes it to move upwards or downwards through the central opening 124.

In an alternative embodiment, the connector 100 may include a second insert 126 having a threaded tube section 128 and a lip 132 extending away from an exterior surface of the tube surface. The tube section 128 of the second insert 126 may be fixedly or removably mounted within the central opening 124 of the first insert 116 and arranged such that the lip 132 contacts the bottom surface of the first insert. The first and second inserts 116, 126 are fixedly mounted together so that they do not rotate with respect to one another. This is important when attempting to tighten the thumb turn 112 so that a sufficient amount of force may be placed onto the glow plug stem 306 by the thumb turn. In certain embodiments, the second insert 126 is welded to the central opening 124 of the first insert 116.

At least a portion of the housing 102 and the fixing member 112 are fabricated from an electrically conductive material. When the connector 100 is installed onto the glow plug 300, the housing 102 is in electrical contact with the body 308 of the glow plug 300 and the fixing member 112 is in electrical contact with the stem 306 of the glow plug 300.

The electrically conductive portions of the housing 102 and the fixing member 112 are electrically isolated from each other. In various embodiments, the first insert 116 is an electrical insulator configured for electrically isolating the second insert 126 and the thumb turn 112 from the housing 102. As mentioned above, once the glow plug 300 contacts the restricting member and the fixing member, an electrical circuit is formed. In this particular embodiment, electric charge flows the current electrical leads 138 (FIG. 1) and then thru pathways 142 in the first insert 116 and are then connected to second insert 126. The second insert 126 is in electrical contact with the fixing member 112, which contacts the stem 306 of the glow plug 300. In this configuration, electric charge flows through the electrically conductive thumb turn 112 and into the glow plug 300 via the stem 306, which causes the glow element to become hot and to heat the combustion chamber. Electricity flows out the glow plug 300 and through the housing 102. One or more additional electrical leads 138 are connected to the housing 102 to provide an electrical pathway back to the energy source. These leads may be mounted to a portion of the outer wall 104 of the housing 102 and then through lead pathways provided in the first insert 116. An advantage of this configuration is that an electrical pathway may be formed by having only one connection step. The connector 100 may be prewired with electrical leads, which allows the electrical pathway to be formed by simply mounting the glow plug 300 within the housing 102.

Figure 7:
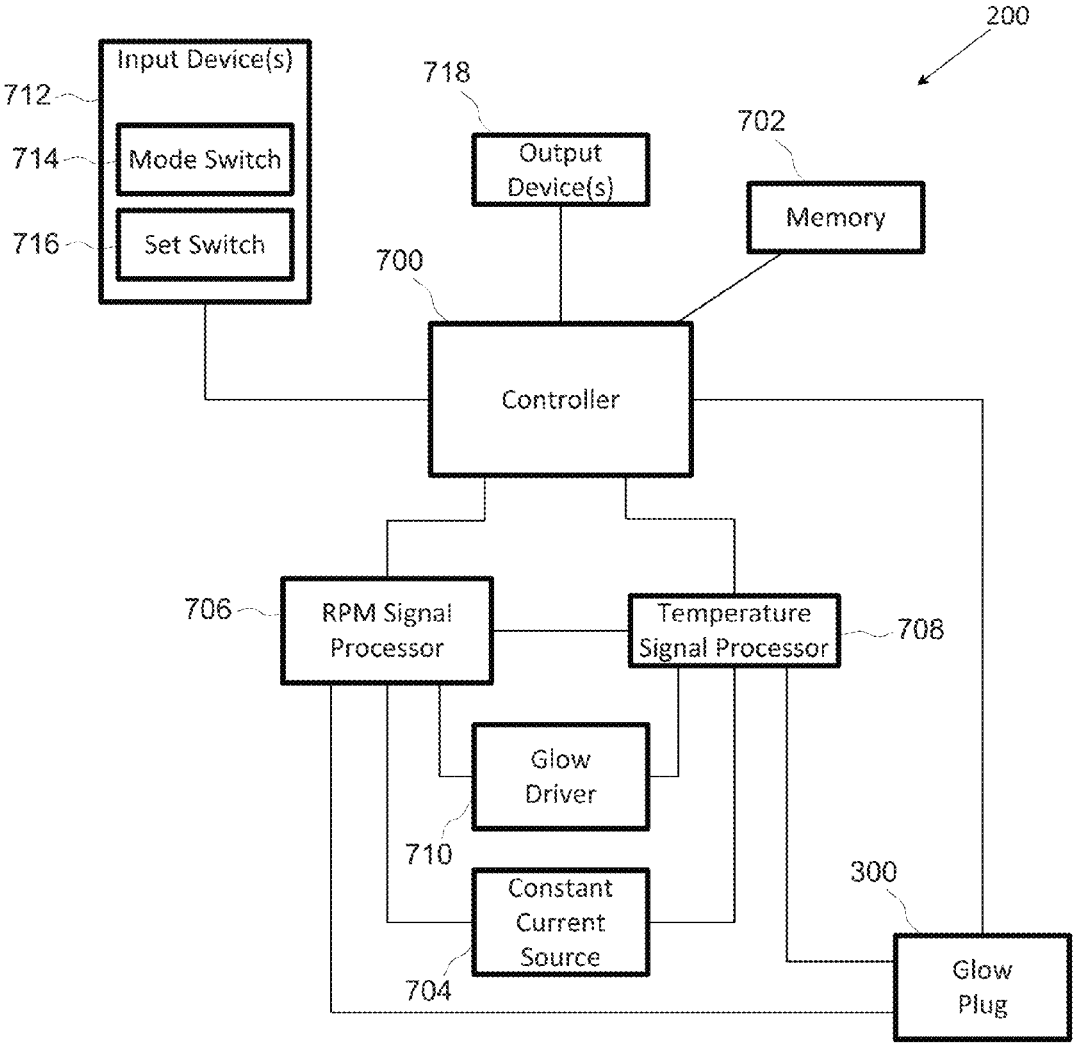
FIG. 7 is a block diagram illustrating aspects of the autonomous glow driver.

FIG. 7 is a block diagram illustrating aspects of the autonomous glow driver control module 200. The control module 200 includes a controller 700, a memory 702, a constant current source 704, a RPM signal processor 706, a temperature signal processor 708, and a glow driver 710. The controller 700 is any circuitry that provides the logical and arithmetic functionality to automate the operation of the autonomous glow driver system. Examples of suitable controller implementations include, but are not limited to, programmable logical controllers, microprocessors, application specific integrated circuits, programmable logic arrays.

In digital logical implementations, one or more memory units 702 provide storage for programs and data used by the controller. The memory units may be integrated into the controller 700 or may be implemented as external components or circuits in communication with the controller.

Optional aspects of the control module 200 include the use of analog-to-digital converters allowing digital processing of analog signals and digital-to-analog converters allowing generation of analog signals using digital logic to drive analog components. When included, such components may be integrated into the controller 700 or may be implemented as external components or circuits in communication with the controller.

When connected to the glow plug, the controller 700 drives the operation of the glow plug 300 based on a set of rules applied to feedback from the glow plug. The basic feedback available to the system includes temperature derived from the resistance of the glow element. The resistance of the glow element in the glow plug varies with temperature. For example, in certain embodiments there is a direct relationship between temperature and resistance, such that when the temperature of the glow plug decreases the resistance also decreases. In other embodiments, there is an inverse relationship between temperature and resistance, such that when the temperature of the glow plug decreases the resistance increases.

An autonomous glow driver based on temperature alone is possible, but reliability is improved by utilizing additional feedback, such as the glow engine RPM. RPM is indicative of a rotating engine whereas temperature is not. The system obtains RPM feedback directly from the glow plug, without requiring a connection to the throttle or other component of the glow engine.

The constant current source 704 produces a continuous current of fixed magnitude when the glow driver is not active, regardless of the total resistance of the glow connector and glow element. The presence of the current simplifies the analysis of the signals by establishing a direct relationship between voltage and resistance. The voltage at the glow plug, which is fed back to the RPM signal processor and temperature signal processor, is related to the changing resistance of the glow plug element corresponding to heating and cooling of the glow plug element.

The RPM signal processor 706 is a differential feedback circuit that produces an output signal having pulses occurring at a frequency corresponding to the RPM of the glow engine. The pulses result from voltage spikes at the glow element due to the change in resistance of the glow element caused by fuel combustion. The RPM signal processor output is converted to a digital signal and supplied to the controller 700 for use in determining when to activate the glow driver.

The temperature signal processor 708 is a controlled differential feedback circuit that produces an output voltage proportional to the temperature of the glow element. The analog temperature signal processor output is converted to a digital signal and supplied to the controller 700 for use in determining when to activate the glow driver in conjunction with the RPM signal processor output.

The glow driver 710 generates a pulse width modulated signal in response to a control signal from the controller 700. The glow driver signal is used to selectively activate the glow plug 300 and provide sufficient heat in the combustion chamber to start or keep the glow engine running. In various embodiments, the glow driver 710 utilizes a power amplifier or transistor, such as a power metal-oxide semiconductor field effect transistor, to provide a resistive switch to provide adequate power for driving the glow plug 300 sourced from the current source 704.

The control module 200 optionally includes one or more input devices 712, such as switches, which allow manual control over selected functionality of the controller. In the illustrated embodiment, the input devices 712 includes a manual switch 714 and a set switch 716. The manual switch 714 allows the user to select a manual start mode that temporarily engages the glow driver when starting the glow engine by hand.

The set switch 716 allows the user to set a trigger voltage level ($V_{set}$), which corresponds to the temperature of the glow element at a selected throttle level, above or below which the controller 202 will activate the glow driver 710. In other embodiment, the set switch 716 enables a variety of other functions such as a voltage monitoring mode, a voltage non-monitoring mode, a radio program mode, or a current source selector mode.

The control module 200 also optionally includes one or more output devices 718, such as visual indicators (e.g., light emitting diodes, lamps, or display screens) or audible indicators (e.g., speakers or piezoelectric transducers) that provide an indication of the status of the autonomous glow driver system to a user. For example, and without limitation, the output devices may indicate when the control module is ready (i.e., power and inactive), when the glow driver is active, when an activation set point has been set, or when fault conditions occur.

Figure 8:
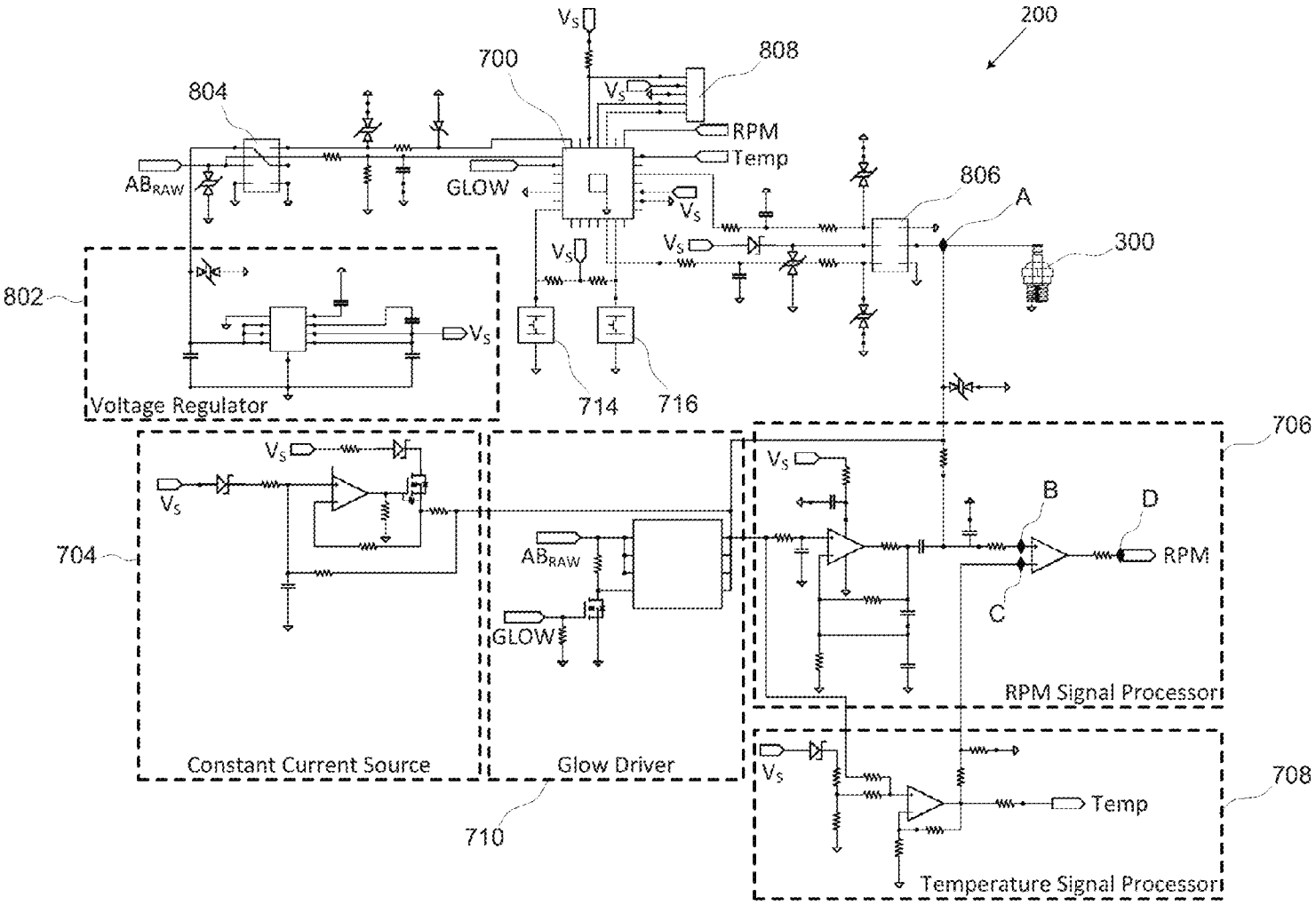
FIG. 8 is a schematic diagram of the control circuit used in one embodiment of the autonomous glow driver.

FIG. 8 is a schematic diagram of the control circuit used in one embodiment of the autonomous glow driver. In addition to exemplary circuits corresponding to the components previously described, the schematic shows additional components of the control module 200 including a voltage regulation circuit 802, a power header 804, a glow header 806, and an optional programming header 808.

The power header 804 provides a connection point for selectively attaching one or more external power sources (e.g., batteries) used to power the autonomous glow driver system. Aspects of the control module also include the ability to optionally connect a radio frequency receiver via the power header 804 to allow remote control and, optionally, monitoring of the autonomous glow driver system.

The glow connector 806 provides a connection point for selectively attaching the control module 200 to the glow plug via the set of electrical leads attached to the connector 100, as previously described.

Aspects of the operation of the control module, including signal acquisition, is explained in detail in relation to FIGS. 9 to 18. The measurement points for the signals illustrated in FIGS. 9 to 16 are marked with diamonds on the schematic of FIG. 8. The measurements were taken at the glow input connection (node A), the non-inverting differential amplifier input (node B) of the RPM signal processor, the inverting differential amplifier input (node C) of the RPM signal processor, and the output of the differential amplifier (node D) of the RPM signal processor. The signals at node D are logic level signals being supplied to the controller 202.

Figure 9:
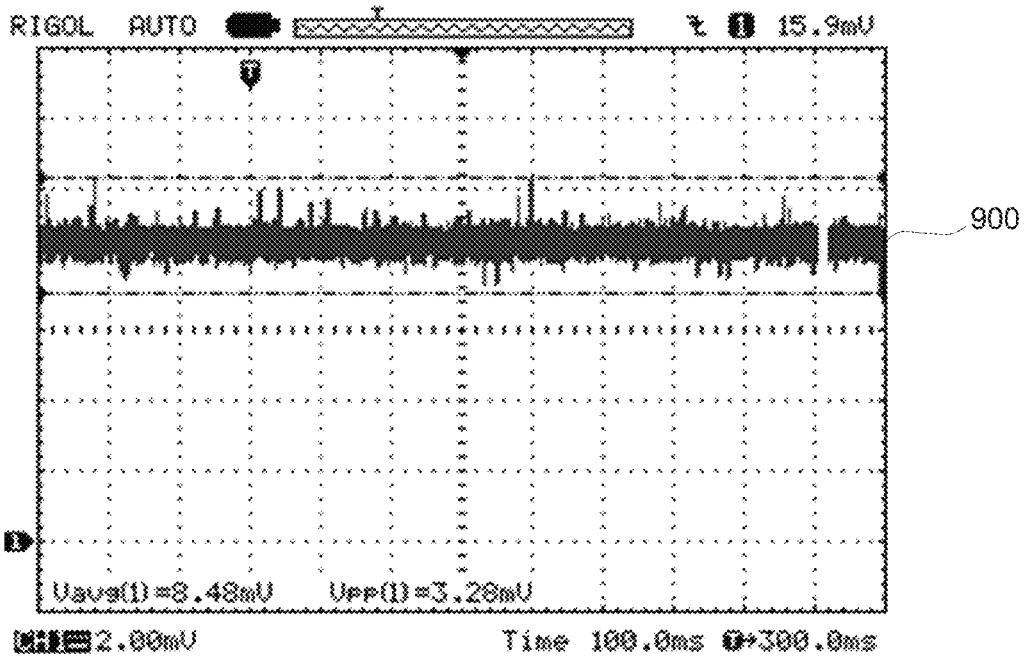
FIG. 9 shows the raw signal from the glow plug for a non-running glow engine measured at the glow input of the control module circuit illustrated in FIG. 8.

FIG. 9 shows the raw signal from a glow plug for a non-running glow engine measured at the glow input of the control module circuit illustrated in FIG. 8. The raw signal was measured at node A, the glow input connection, using a digital oscilloscope. The average voltage of the raw signal was measured at 8.48 mV with 3.28 mVpp of noise.

Figure 10:
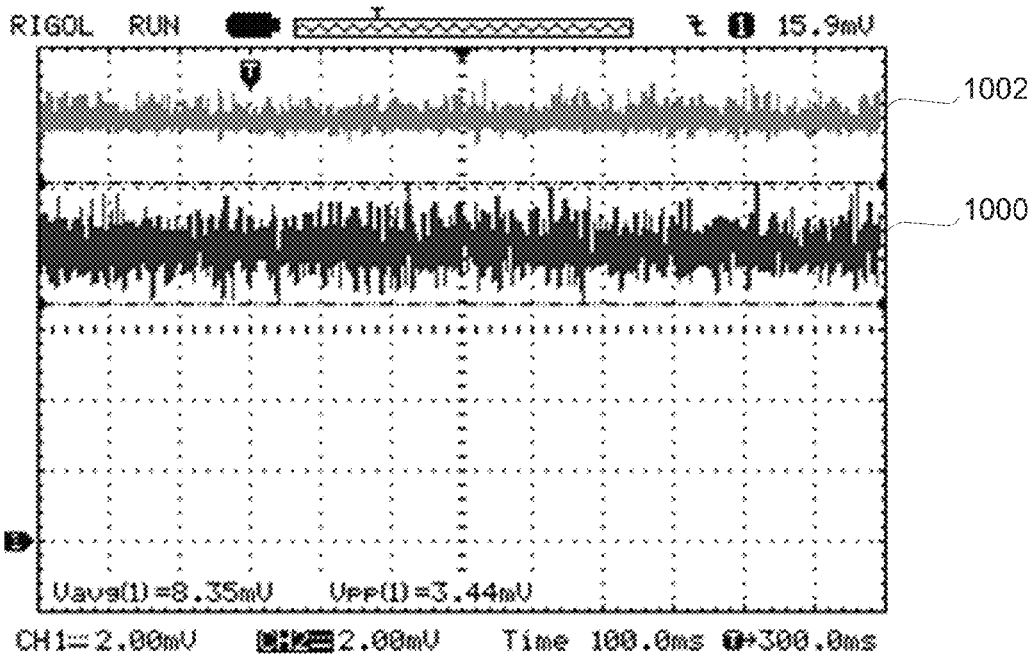
FIG. 10 shows the feedback signals from the glow plug for a non-running glow engine measured at the inputs to the differential amplifier in the control module circuit illustrated in FIG. 8.

FIG. 10 shows the feedback signals from a glow plug for a non-running glow engine measured at the inputs to the differential amplifier in the control module circuit illustrated in FIG. 8. The upper signal represents the trigger threshold for the lower signal. The lower signal has a larger peak-to-peak voltage value when compared to the upper signal due to the significant amplification of the original signal. The RPM data, if present, would appear in the lower signal. However, in this particular screenshot, there are no RPM signals present.

Figure 11:
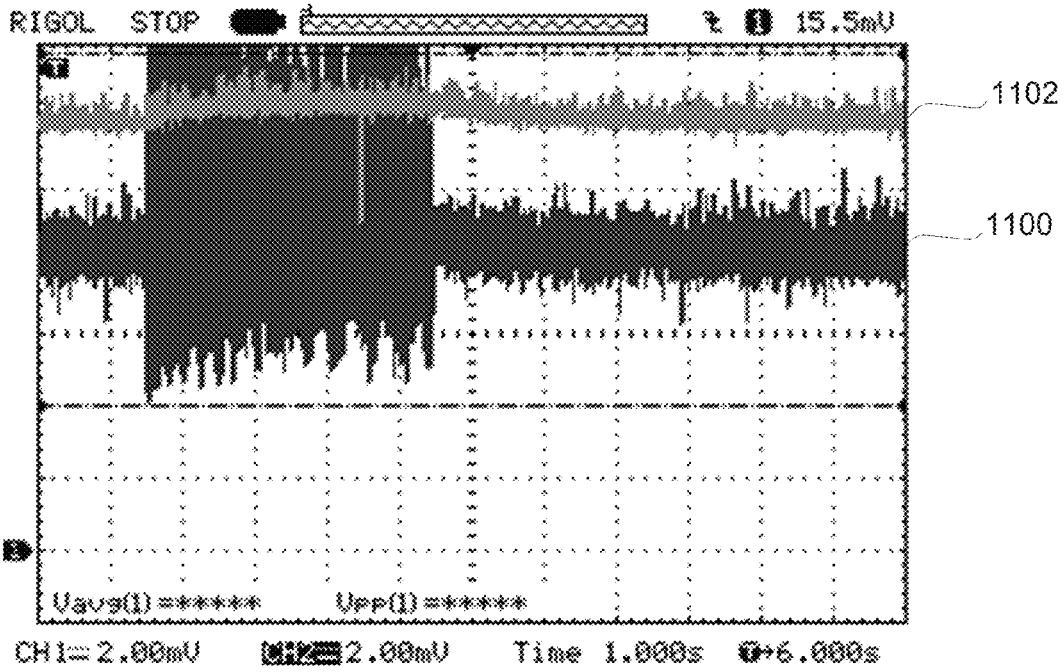
FIG. 11 shows the feedback signals from the glow plug measured at the inputs to the differential amplifier while a field starter is applied to the glow engine and the glow driver remains inactive.

FIG. 11 shows the feedback signals from the glow plug measured at the inputs to the differential amplifier while a field starter is applied to the glow engine and the glow driver remains inactive. The upper signal exhibits a slight increase in voltage. An increase in the voltage of the lower signal is also present but masked by the solid RPM signal. The significant increase in the peak-to-peak voltage of the lower signal is the result of a turning crank of the glow engine and amplification of the non-running RPM signal.

Figure 12:
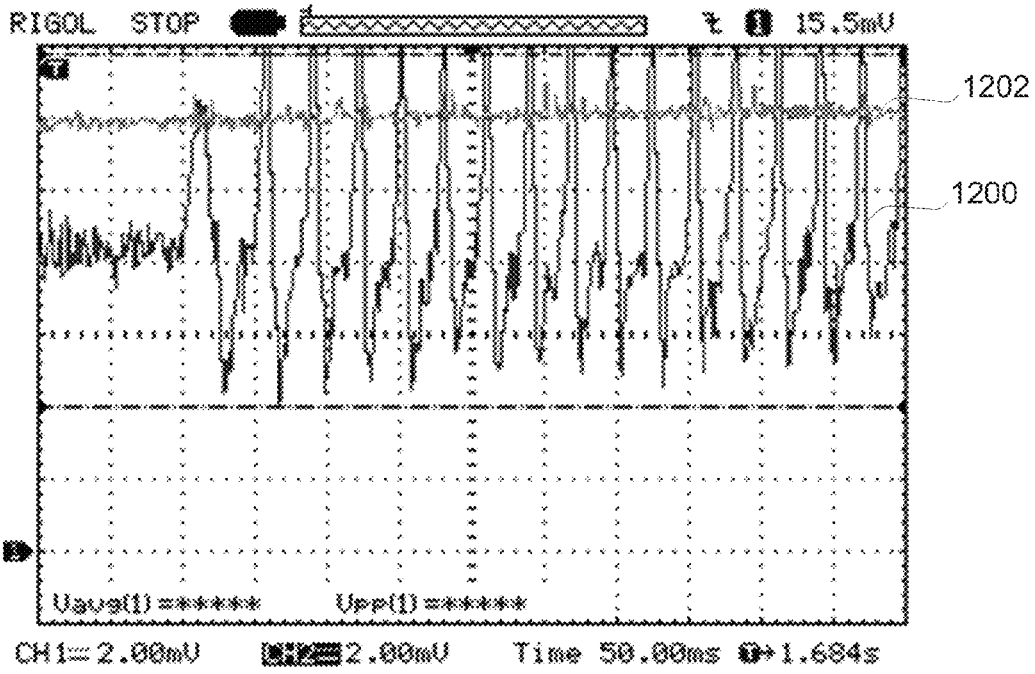
FIG. 12 shows the feedback signals from FIG. 11 at 20 times magnification.

FIG. 12 shows the feedback signals from FIG. 11 at 20 times magnification of horizontal divisions of one (1) second. As can be seen, the peaks of the lower signal 1200 break through the reference voltage 1202 producing signal pulses producing a pulse train at the output of the differential amplifier of the RPM signal processor that is fed back to the controller. The illustrated pulses have a period of a period of approximately 35 milliseconds, which translates to a frequency of approximately 28.5 Hz, or 1,714 RPM. The frequency of the pulse train represents the rotational speed imparted to the engine by the field starter. Again, this is still a non-running RPM that is present only because the field starter is being applied. Ideally, with the field starter applied and the glow driver active, the engine will crank and begin running. The controller recognizes running RPMs because they are much higher than non-running RPMs produced by a field starter or other starting means.

Figure 13:
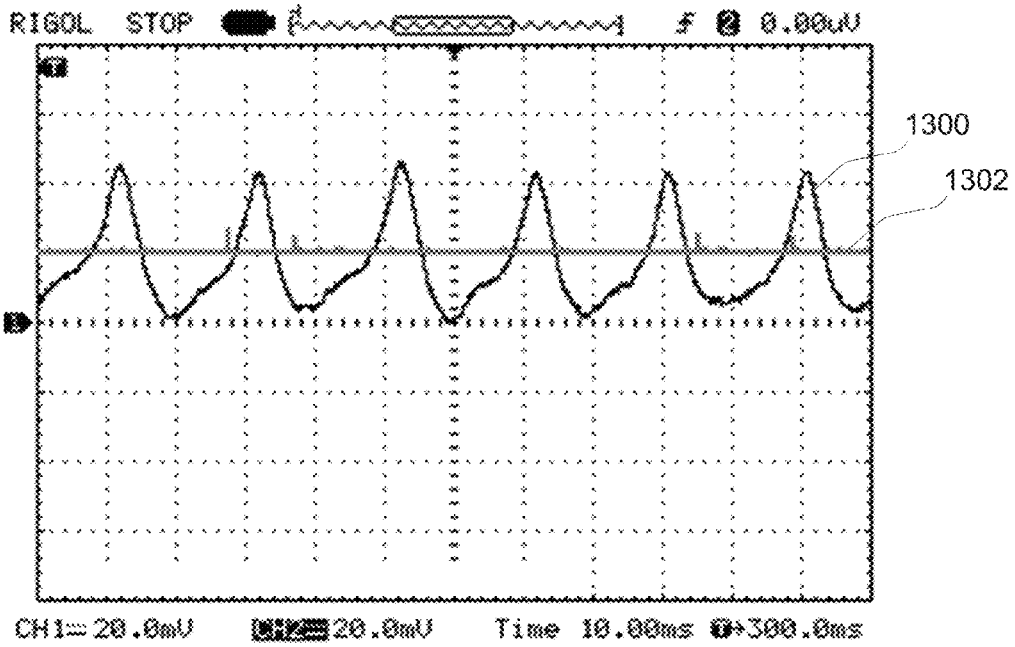
FIG. 13 shows the feedback signals from a glow plug for a glow engine running at low idle measured at the inputs to the differential amplifier.

FIG. 13 shows the feedback signals from a glow plug for a glow engine running at low idle measured at the inputs to the differential amplifier. The periodic input waveform 1300 was measured at node B and the reference voltage 1302 was measured at node C.

Figure 14:
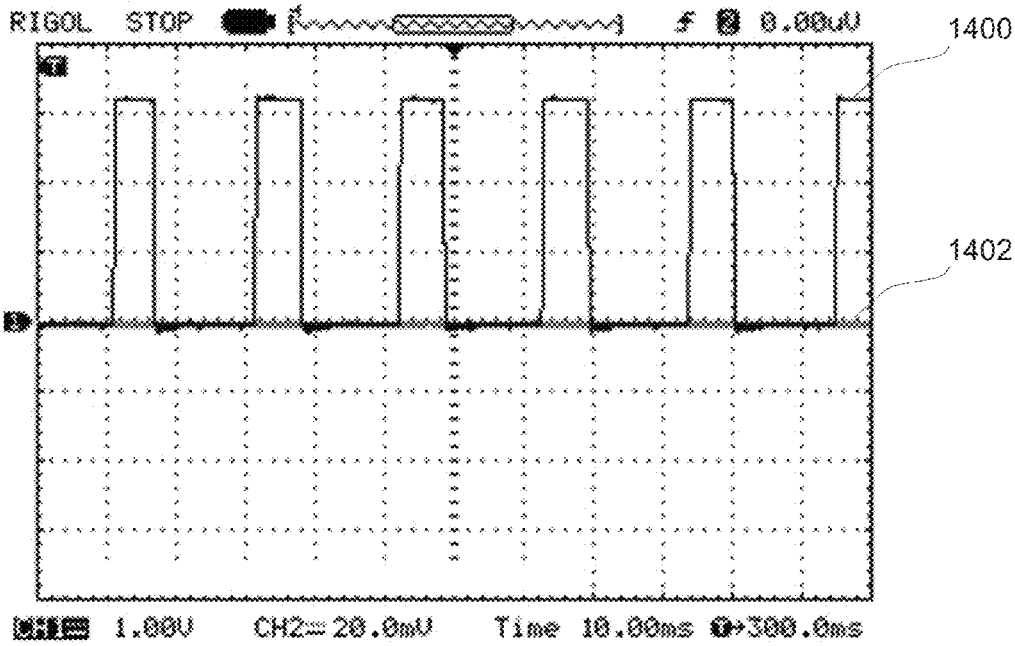
FIG. 14 shows the output of the differential amplifier and the corresponding reference voltage from a glow plug in a glow engine running at low idle.

FIG. 14 shows the output of the differential amplifier and the corresponding reference voltage from a glow plug in a glow engine running at low idle. The periodic output waveform 1400 was measured at node D and the reference voltage 1402 was measured at node C. The controller calculates the RPM based on the period of the periodic output signal 1400. Based on the illustrated periodic output waveform 1400, the glow engine is calculated to be operating at approximately 3,000 RPM.

Figure 15:
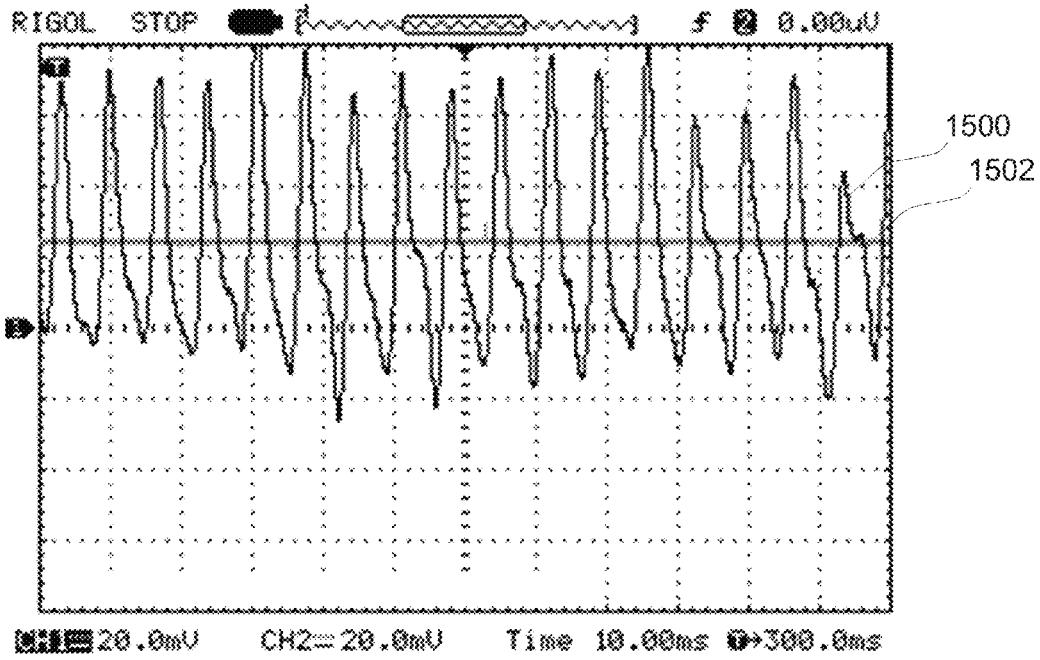
FIG. 15 shows the feedback signals from a glow plug for a glow engine running in the mid to upper throttle range measured at inputs to the differential amplifier.

FIG. 15 shows the feedback signals from a glow plug for a glow engine running in the mid to upper throttle range measured at the inputs to the differential amplifier. The periodic waveform 1500 was measured at node B and the reference voltage 1502 was measured at node C.

Figure 16:
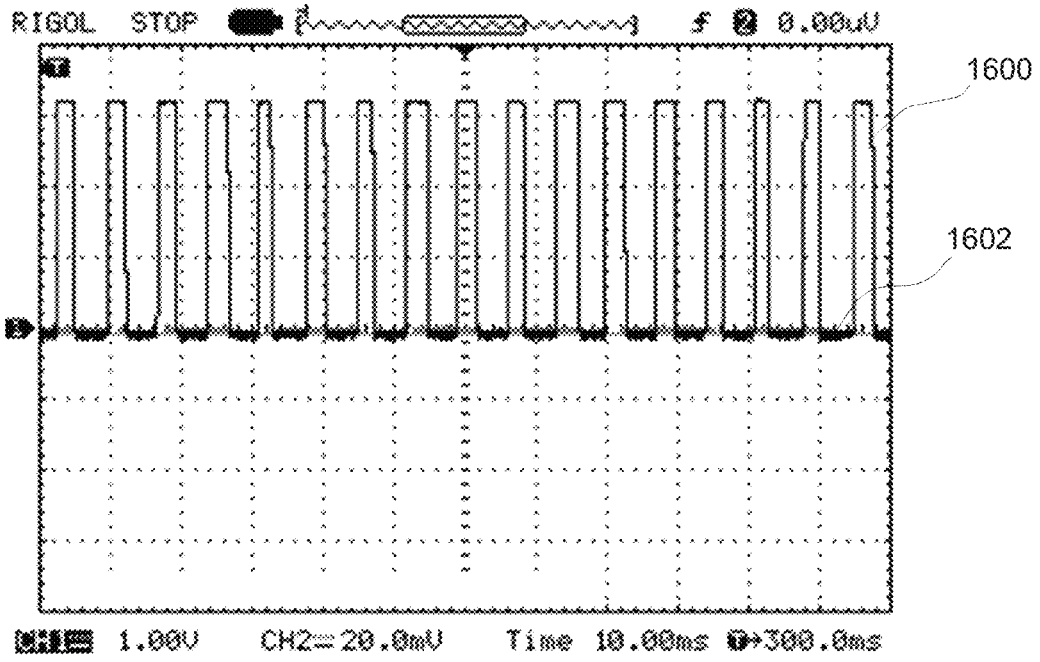
FIG. 16 shows the output of the differential amplifier and the corresponding reference voltage from a glow plug in a glow engine running in the mid to upper throttle range.

FIG. 16 shows the output of the differential amplifier and the corresponding reference voltage from a glow plug in a glow engine running in the mid to upper throttle range. The periodic waveform 1600 was measured at node D and the reference voltage 1602 was measured at node C. The controller calculates the RPMs based on the period of the periodic output signal 1600. Based on the illustrated periodic output waveform 1600, the glow engine is calculated to be operating at approximately 7,500 RPMs. As the RPMs increase, the magnitude of the input signal 1500 and the output signal frequency 1600 increase as the result of more fuel combustion leading to greater heat and RPM, respectively. Likewise, the reference voltage 1502, 1602 increases slightly due to the increase in the average resistance of the glow element corresponding to the increase in heat.

Figure 17:
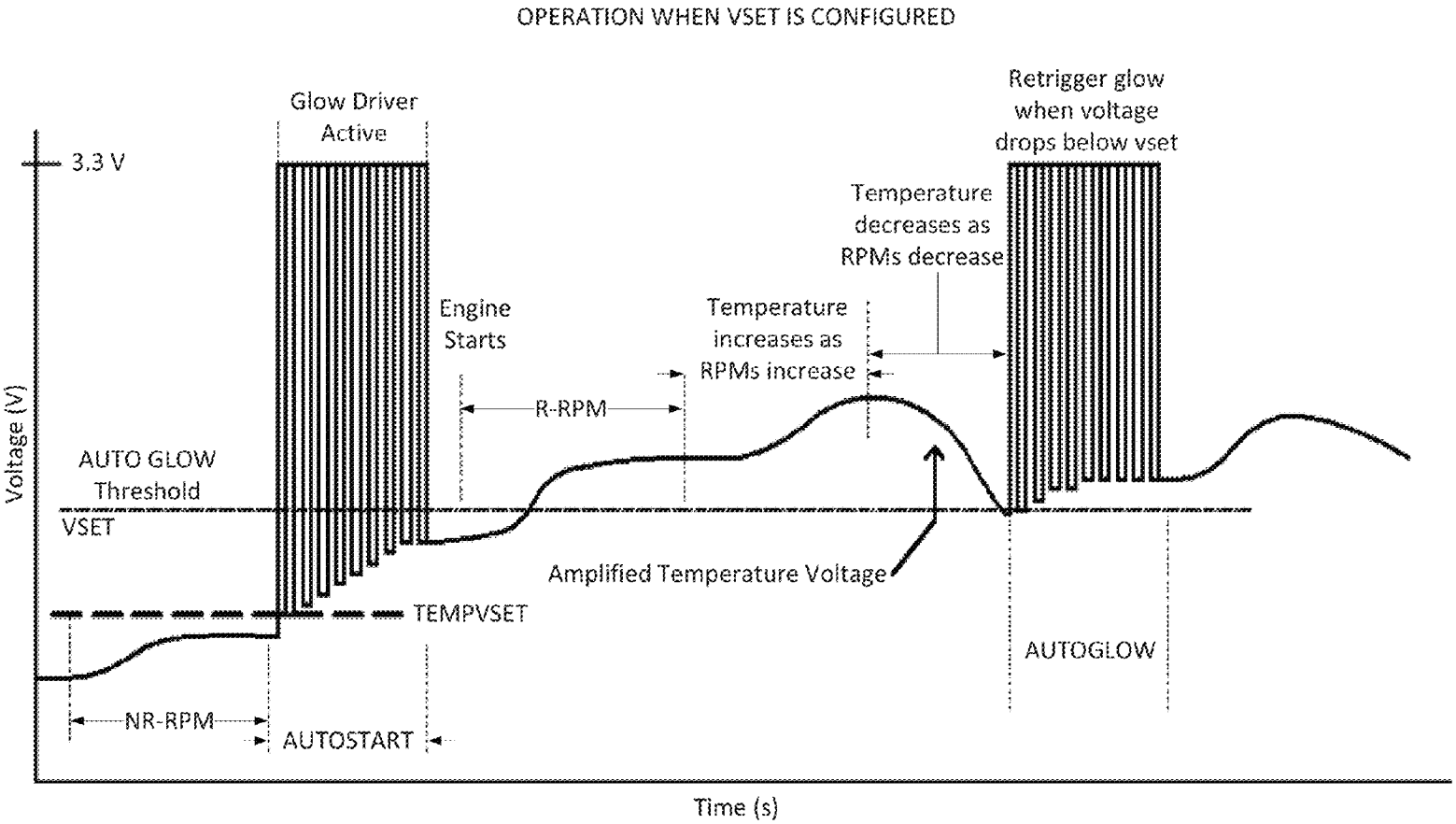
FIG. 17 illustrates a simplified sequence of events for the autonomous glow driver AUTOSTART and AUTOGLOW modes.

FIG. 17 illustrates a simplified sequence of events for the autonomous glow driver AUTOSTART and AUTOGLOW modes. Only the voltage representing temperature is shown. In this example, the field starter is applied to the engine, which causes there to be non-running RPMs and a corresponding rise in temperature of the glow element. The controller 700 senses the engine is to be started due to the presence of the non-running RPMs. The controller 700 optionally determines that the temperature of the glow element is below the automatically set TEMPVSET voltage. If there are non-running RPMs, the controller 700 activates the glow driver for a set interval (e.g., 4 seconds). Optionally, the controller 700 activates the glow driver only if there are non-running RPMs and the temperature is below the TEMPVSET voltage. When the field starter is applied and glow driver is active, high voltages saturate the operational amplifiers to near their upper rail voltages indicated by the 3.3 volt limit.

After the set interval, the controller checks the RPMs again. If running RPMs are detected, the glow driver is not activated again. Conversely, if running RPMs are not detected, the controller 700 will continue to activate the glow driver in timed intervals until running RPMs are detected, which indicate that the glow engine has successfully started. After the glow driver turns off and the engine starts running by itself (i.e., producing a running RPM), the field starter is removed.

As the engine runs, the temperature voltage increases as the overall temperature of the engine and glow plug increase to a point of equilibrium at some given throttle input. The trigger voltage ($V_{set}$) is an optional voltage level set while the engine is running. When the auto trigger voltage is set, the auto-glow will activate whenever the temperature voltage dips below the auto trigger voltage. When the glow element temperature falls (e.g., due to reduced throttle or a decrease in ambient temperature) below the trigger voltage $V_{set}$, the controller activates the glow driver in a timed intervals until the desired temperature is reached.

Figure 18:
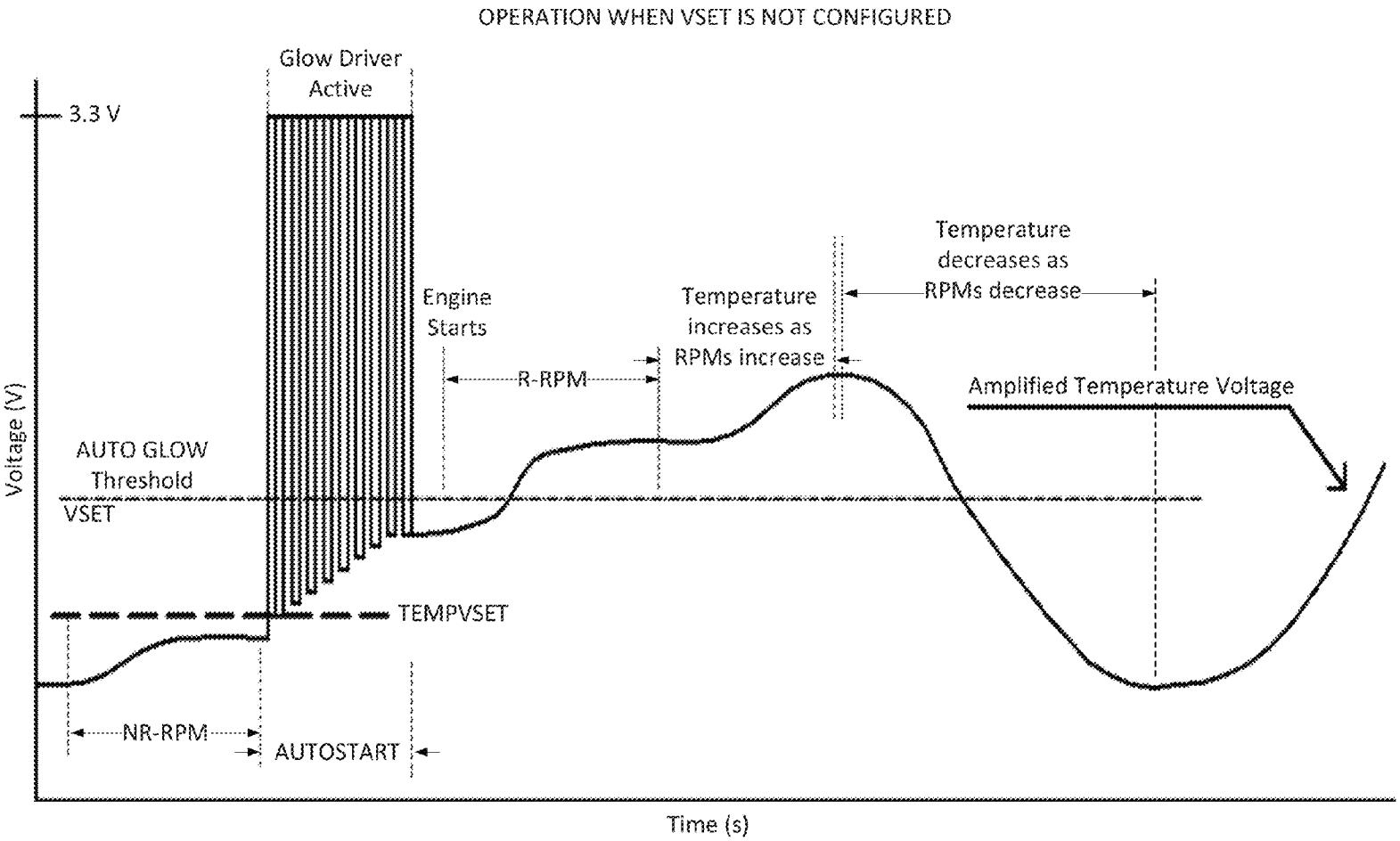
FIG. 18 illustrates a simplified sequence of events for the autonomous glow driver operation when the trigger voltage $V_{set}$ has not been configured.

FIG. 18 illustrates a simplified sequence of events for the autonomous glow driver operation when the trigger voltage $V_{set}$ has not been configured. If the optional trigger voltage $V_{set}$ is not set, then only the AUTOSTART function is active. In other words, the AUTOGLOW function is not active. Instead, the TEMPVSET voltage, at a far lower voltage level, is used. The TEMPVSET voltage represents a voltage level corresponding to a minimum temperature or non-running RPM level where the glow driver is activated in order to start or keep the glow engine running. The firmware automatically sets the TEMPVSET voltage when the control module initializes if the running temperature trigger voltage $V_{set}$ is not saved to the memory. One technique for automatically configuring the TEMPVSET voltage is for the controller to take the voltage reading of the glow element during initialization, which corresponds to the ambient temperature, and adding a selected voltage offset (e.g., a voltage offset corresponding to 62 millivolts).

The sequence begins with the AUTOSTART phase previously described in reference to FIG. 17. Following the AUTOSTART phase, the temperature dips down until it falls below the TEMPVSET voltage. At that point, the controller does not activate the glow driver. Since $V_{set}$ has not been recorded to memory, AUTOGLOW is inactive.

For safety reasons, some embodiments of the system are configured to not activate the glow plug when the glow engine is operating below a minimum RPM threshold. Typically, the minimum RPM threshold is set at a level that is less than the RPM achieved during an intentional movement of the draft shaft, such as by a field starter. Without limitation, an exemplary minimum RPM threshold is approximately 600 RPMs (10 Hz).

In order to facilitate use when starting the glow engine by hand, some embodiments of the system include a manual switch that allows a user to override the restriction on activating the glow driver below the minimum RPM threshold. This allows the glow driver to be used when hand starting the glow engine. While manual is active, the controller ignores the minimum RPM threshold and activates the glow driver.

In various embodiments, the system automatically deactivates the manual glow and reverts to AUTOSTART mode when one or more selected conditions occur, such as the passage of a preset amount of time since the manual glow mode was activated. For example, in some embodiments, an optional timer is started when manual glow is activated, and the system automatically reverts to AUTOSTART mode after the preset amount of the time passes (e.g., 12 seconds). If the glow engine has not been successfully started before the system automatically reverts to AUTOSTART mode, the user may simply reactivate manual glow mode as many times as needed to start the glow engine.

Generally, when starting a glow engine by hand, the glow engine drive shaft is repeatedly turned on a less rapid and frequent basis until the glow engine starts. Each deliberate movement of the glow engine drive shaft causes an RPM signal. As mentioned previously, for safety reasons, the glow will not activate automatically if a low RPM (e.g., 10 Hz or less) is detected. The manual glow overrides this general rule and it must be implemented for low RPM situations, such as hand flipping and/or pull type starting.

The foregoing description of embodiments for this invention has been presented for purposes of illustration and description. It is not intended to be exhaustive or to limit the invention to the precise form disclosed. Obvious modifications or variations are possible in light of the above teachings. The embodiments are chosen and described in an effort to provide illustrations of the principles of the invention and its practical application, and to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. An apparatus for use in operating a glow plug that is mounted to an engine, the apparatus comprising:

an electrical circuit connected to the glow plug and producing a temperature signal that corresponds to a temperature of the glow plug;

an RPM signal processor receiving the temperature signal and generating an RPM signal corresponding to an engine speed of the engine, the RPM signal being derived exclusively from the temperature signal produced by the electrical circuit;

a glow driver that selectively powers the glow plug based on a control signal; and a controller that receives, as a first input, the RPM signal from the RPM signal processor and produces a control signal based on the first input and then sends the control signal to the glow driver to power the glow plug.

2. The apparatus of claim 1 wherein the controller receives, as a second input, the temperature signal from the temperature signal processor and produces the control signal based on the first and second inputs.

3. The apparatus of claim 1 wherein the electrical circuit is connected to the glow plug and measures a voltage across the glow plug, wherein the measured voltage varies as the temperature of the glow plug varies, and the electrical circuit produces the temperature signal based on the measured voltage.

4. The apparatus of claim 1 wherein the RPM signal processor measures a frequency of the temperature signal and produces the RPM signal as a series of pulses that occur at a frequency corresponding to the engine speed.

5. The apparatus of claim 4 wherein the controller stores a reference value and produces an offset signal based on the reference value, wherein the RPM signal processor receives the offset signal and produces a trigger signal corresponding to both the offset signal and the temperature signal, and wherein the RPM signal compares the temperature signal to the trigger signal and produces one of the pulses each time the temperature signal exceeds the trigger signal.

6. The apparatus of claim 5 wherein the electrical circuit is connected to the glow plug, measures a voltage across the glow plug that varies as the temperature of the glow plug varies, and generates the temperature signal based the measured voltage; wherein the RPM processor generates the trigger signal to be equal to a DC-component of the voltage across the glow plug plus the offset signal; and wherein the RPM signal processor generates a pulse in the RPM signal when an AC magnitude of the temperature signal exceeds the trigger signal.

7. A method of operating a glow plug that is mounted to an engine, the method comprising the steps of:

obtaining an electrical output from the glow plug;

producing a temperature signal based on the electrical output of the glow plug, where the temperature signal corresponds to the temperature of the glow plug;

receiving the temperature signal and generating an RPM signal derived exclusively from the temperature signal, where the RPM signal corresponds to an engine speed of the engine, and selectively producing a control signal based on the RPM signal; and selectively powering the glow plug in response to the control signal.

8. The method of claim 7 further comprising producing the control signal based on both the RPM signal and the temperature signal.

9. The method of claim 7 further comprising the step of detecting a voltage across the glow plug, wherein the voltage varies as the temperature of the glow element varies and producing the temperature signal based on the voltage.

10. The method of claim 7 further comprising the step of measuring a frequency of the temperature signal and producing the RPM signal as a series of pulses that occur at a frequency corresponding to the engine speed and corresponding to the measured frequency of the temperature signal.

11. The method of claim 10 further comprising the steps of: storing a predetermined reference value to a memory; producing an offset signal corresponding to the reference value; producing a series of pulses representing the RPM signal based on the offset signal and the temperature signal.

12. The method of claim 11 wherein the producing step comprises:

adding the offset signal to a DC value of the temperature signal to produce a trigger signal:

comparing the AC value of the temperature signal to the trigger signal and producing a series of pulses as the RPM signal, a pulse being produced each time the AC value of the temperature signal exceeds the value of the trigger signal.

13. A hobby engine system comprising:

a hobby engine;

a glow plug having a glow element and mounted to the hobby engine;

a connector mounted to the glow plug;

a controller in electrical communication in communication with the connector and the glow plug for operating the glow plug, the controller having:

an electrical circuit connected to the glow plug and producing a temperature signal that corresponds to the temperature of the glow plug;

an RPM signal processor receiving the temperature signal and generating an RPM signal corresponding to an engine speed of the engine, the RPM signal being derived exclusively from the temperature signal produced by the electrical circuit;

a controller that receives, as a first input, the RPM signal from the RPM signal processor and produces a control signal based on the first input and then sends the control signal to the glow driver to operate the glow plug; and a glow driver that selectively powers the glow plug based on the control signal.

* * * * *